US010424308B2

(12) United States Patent
Ehara et al.

(10) Patent No.: US 10,424,308 B2
(45) Date of Patent: Sep. 24, 2019

(54) AUDIO SOUND SIGNAL ENCODING DEVICE, AUDIO SOUND SIGNAL DECODING DEVICE, AUDIO SOUND SIGNAL ENCODING METHOD, AND AUDIO SOUND SIGNAL DECODING METHOD

(71) Applicant: Panasonic Intellectual Property Corporation of America, Torrance, CA (US)

(72) Inventors: Hiroyuki Ehara, Kanagawa (JP); Takanori Aoyama, Hiroshima (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 15/976,987

(22) Filed: May 11, 2018

(65) Prior Publication Data

US 2018/0261233 A1 Sep. 13, 2018

Related U.S. Application Data

(63) Continuation of application No. PCT/JP2016/004891, filed on Nov. 16, 2016.

(30) Foreign Application Priority Data

Dec. 15, 2015 (JP) ..... 2015-244243

(51) Int. Cl.
*G10L 19/008* (2013.01)
*G10L 19/00* (2013.01)
(Continued)

(52) U.S. Cl.
CPC ..... *G10L 19/008* (2013.01); *G10L 19/00* (2013.01); *H04R 1/406* (2013.01); *H04S 3/008* (2013.01); *H04S 2400/15* (2013.01)

(58) Field of Classification Search
CPC ..... G10L 19/00; G10L 19/008; H04R 1/406; H04S 3/008; H04S 2400/15
See application file for complete search history.

(56) References Cited

U.S. PATENT DOCUMENTS

2006/0246868 A1* 11/2006 Taleb ..... G10L 19/002 455/303
2010/0189281 A1* 7/2010 Oh ..... G10L 19/008 381/94.1

FOREIGN PATENT DOCUMENTS

EP 2254110 A1 11/2010

OTHER PUBLICATIONS

International Search Report of PCT application No. PCT/JP2016/004891 dated Jan. 31, 2017.
(Continued)

*Primary Examiner* — Mark Fischer
(74) *Attorney, Agent, or Firm* — Greenblum & Bernstein, P.L.C.

(57) ABSTRACT

An audio sound signal encoding device includes: a converter that adds up all multiple channel signals included in multi-channel voice sound input signals to generate an addition signal and generates a difference signal between channels of the multiple channel signals; a first encoder that encodes the addition signal in a coding mode in accordance with a characteristic of the addition signal to generate first encoded data; a second encoder that encodes the difference signal in the coding mode that was used for encoding the addition signal, to generate second encoded data; and a multiplexer that multiplexes the first encoded data and the second encoded data to generate multichannel encoded data.

11 Claims, 5 Drawing Sheets

(51) Int. Cl.
*H04R 1/40* (2006.01)
*H04S 3/00* (2006.01)

(56) References Cited

OTHER PUBLICATIONS

3GPP TS 26.445 V12.4.0, "3rd Generation Partnership Project; Technical Specification Group Services and System Aspects; Codec for Enhanced Voice Services (EVS); Detailed Algorithmic Description (Release 12)", Sep. 2015.
Futoshi Asano, "Griffiths-Jim Type Adaptive Beamformer with Divided Structure", IEICE Technical Report, EA95-97, Mar. 1996, pp. 17-24.
Extended European Search Report, dated Aug. 21, 2018, by the European Patent Office (EPO) for the related European Patent Application No. 16875095.8.
Jurgen Herre: "From Joint Stereo to Spatial Audio Coding—Recent Progress and Standardization", Proceedings of the 7th International Conference on Digital Audioeffects, Oct. 5-8, 2004, pp. 157-162, XP002367849.
Mark Kahrs et al.: "The Past, Present, and Future of Audio Signal Processing", IEEE Signal Processing Magazine, IEEE Service Center, Piscataway, NJ, US, vol. 14, No. 5, Sep. 1, 1997, pp. 30-57, XP011244410.

* cited by examiner

AUDIO SOUND SIGNAL ENCODING DEVICE, AUDIO SOUND SIGNAL DECODING DEVICE, AUDIO SOUND SIGNAL ENCODING METHOD, AND AUDIO SOUND SIGNAL DECODING METHOD

BACKGROUND

1. Technical Field

The present disclosure relates to an audio sound signal encoding device, an audio sound signal decoding device, an audio sound signal encoding method, and an audio sound signal decoding method.

2. Description of the Related Art

An algorithm of the Enhanced Voice Services (EVS) codec is disclosed in 3GPP TS 26.445 v12.4.0, "Codec for Enhanced Voice Services (EVS); Detailed Algorithmic Description (Release 12)". The EVS codec enables efficient encoding and decoding processing with high quality on a voice sound signal (hereinafter, simply referred to as a "sound signal") by analyzing an input signal and encoding the input signal using an optimum coding mode in accordance with the characteristics of the input signal.

A technique for a beamformer (for example, Griffiths-Jim type adaptive beamformer) using a microphone array is disclosed in Futoshi Asaono, "Griffiths-Jim Type Adaptive Beamformer with Divided Structure", IEICE technical report EA95-97 (1996-03), pp. 17-24. This report discloses, as an example of a Griffiths-Jim type adaptive beamformer, a configuration for extracting a sound signal coming from a specific direction, using a sum signal of the channel signals of the microphone array and difference signals between adjacent channel signals.

In the case where the channel signals in the multichannel signals acquired with a microphone array are independently encoded using the EVS codec, an independent encoding error will be added to each of the channel signals. This will cause the deterioration of the correlation between the channel signals and affect the beamforming processing which utilizes the correlation between the channel signals.

SUMMARY

One non-limiting and exemplary embodiment provides an audio sound signal encoding device, audio sound signal decoding device, audio sound signal encoding method, and audio sound signal decoding method in which the degradation of beamforming performance is suppressed in the case of encoding multichannel signals using the EVS codec.

In one general aspect, the techniques disclosed here feature an audio sound signal encoding device including: a converter that adds up all multiple channel signals included in multichannel voice sound input signals to generate an addition signal and generates a difference signal between channels of the multiple channel signals; a first encoder that encodes the addition signal in a coding mode in accordance with a characteristic of the addition signal to generate first encoded data; a second encoder that encodes the difference signal in the coding mode that was used for encoding the addition signal, to generate second encoded data; and a multiplexer that multiplexes the first encoded data and the second encoded data to generate multichannel encoded data.

It should be noted that general or specific embodiments may be implemented as a system, a device, a method, an integrated circuit, a computer program, a recording medium, or any selective combination thereof.

An aspect of the present disclosure suppresses the degradation of beamforming performance in the case of encoding multichannel signals using the EVS codec.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Hereinafter, embodiments of the present disclosure are described in detail with reference to the drawings.

Embodiment 1

[System Configuration]

Figure 1:
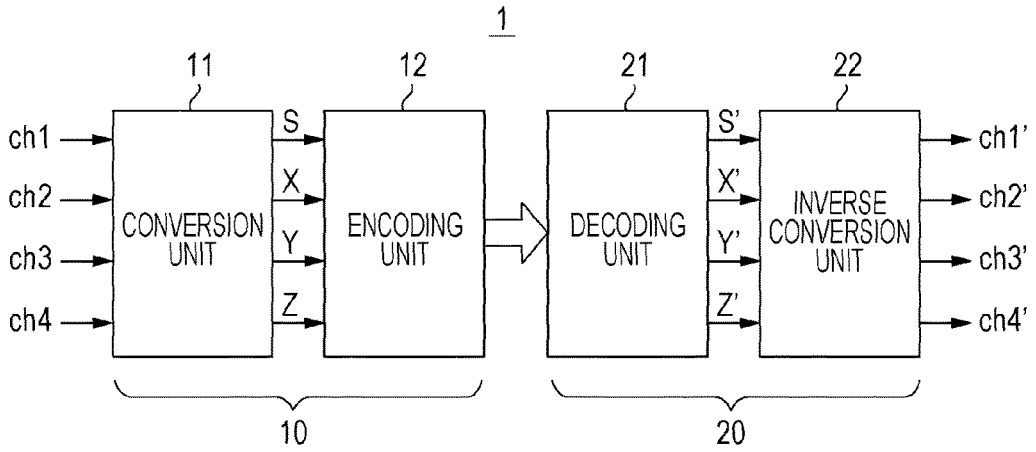
FIG. 1 is a diagram illustrating a configuration example of a multichannel sound signal encoding and decoding system.

FIG. 1 illustrates a configuration example of a system according to this embodiment. A system 1 illustrated in FIG. 1 includes at least an encoding device 10 (multichannel encoding unit) which encodes audio sound signals and a decoding device 20 (multichannel decoding unit) which decodes audio sound signals.

Inputted into the encoding device 10 are channel signals of multichannel digital sound signals. For example, the multichannel digital sound signals are obtained by acquiring analog sound signals with a microphone array unit (not illustrated) and performing digital conversion on the signals. Note that although FIG. 1 illustrates a case where four channel signals (ch1 to ch4) are inputted, the number of channels of the multichannel digital sound signals are not limited to four.

[Configuration of Encoding Device]

The encoding device 10 includes a conversion unit 11 (corresponding to a converter) and an encoding unit 12.

The conversion unit 11 performs weighted addition processing on the channel signals (ch1 to ch4), which are input signals, to convert the channel signals (ch1 to ch4) into multichannel digital signals (S, X, Y, Z).

Figure 2:
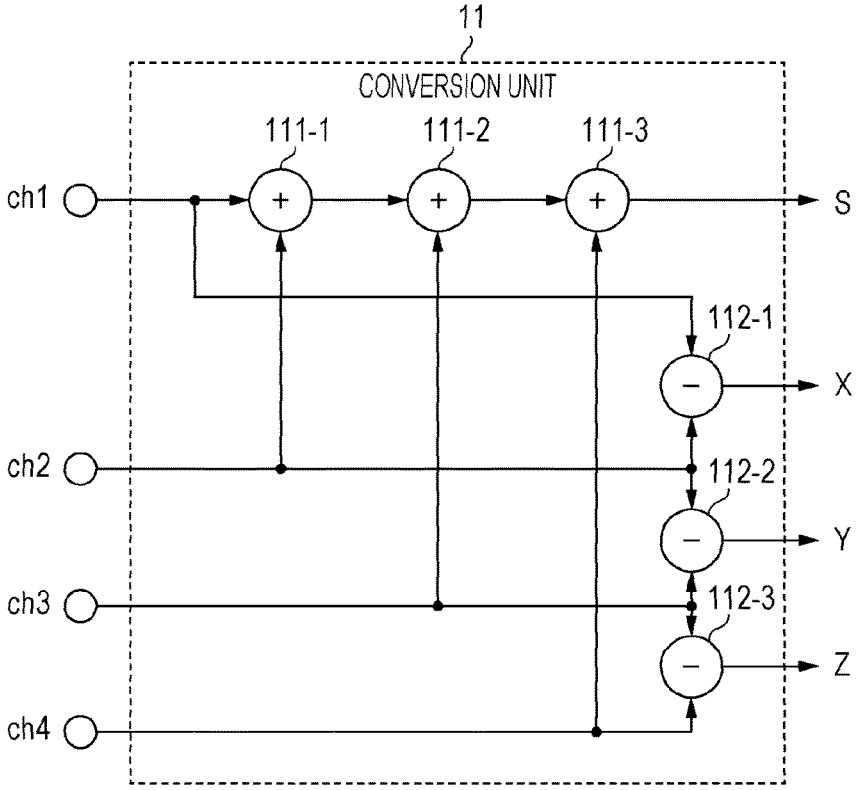
FIG. 2 is a diagram illustrating an example of the internal configuration of a conversion unit.

FIG. 2 illustrates an example of the internal configuration of the conversion unit 11. In FIG. 2, adding units 111-1, 111-2, and 111-3 add up all the multiple channel signals ch1 to ch4 to generate an addition signal S (S=ch1+ch2+ch3+ch4).

Subtracting units 112-1, 112-2, and 112-3 illustrated in FIG. 2 generate difference signals between channels of the multiple channel signals ch1 to ch4. For example, in FIG. 2, the subtracting unit 112-1 generates a difference signal X (X=ch1−ch2) between the adjacent channel signals ch1 and ch2, the subtracting unit 112-2 generates a difference signal Y (Y=ch2−ch3) between the adjacent channel signals ch2 and ch3, and the subtracting unit 112-3 generate a difference signal Z (Z=ch3−ch4) between the adjacent channel signals ch3 and ch4.

The conversion unit 11 outputs multichannel digital signals including the addition signal S and the difference signals X, Y, and Z to the encoding unit 12.

The encoding unit 12 encodes the multichannel digital signals outputted from the conversion unit 11 using the EVS codec to generate monophonic encoded data, and multiplexes the monophonic encoded data to output it as multichannel encoded data.

Figure 3:
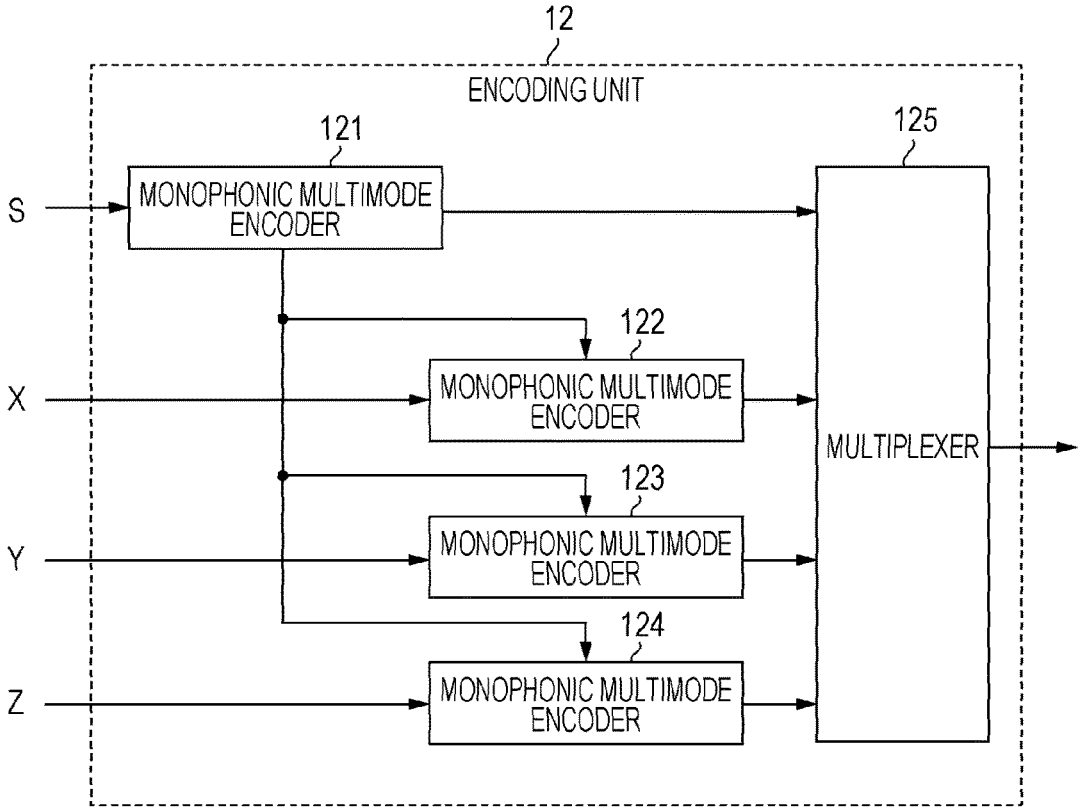
FIG. 3 is a diagram illustrating an example of the internal configuration of an encoding unit.

FIG. 3 illustrates an example of the internal configuration of the encoding unit 12. The encoding unit 12 illustrated in FIG. 3 includes monophonic multimode encoding units 121, 122, 123, and 124 and a multiplexer 125.

The monophonic multimode encoding unit 121 (corresponding to a first encoder) encodes the addition signal S inputted from the conversion unit 11 to generate the monophonic encoded data (corresponding to first encoded data). The monophonic multimode encoding unit 121 outputs the monophonic encoded data to the multiplexer 125.

Note that in encoding, the monophonic multimode encoding unit 121 determines the coding mode according to the characteristic of the inputted addition signal S (for example, the type of signal, such as voice or non-voice) and encodes the addition signal S using the determined coding mode. The monophonic multimode encoding unit 121 outputs mode information indicating the coding mode used for encoding the addition signal S to the monophonic multimode encoding units 122 to 124. The monophonic multimode encoding unit 121 encodes the mode information and includes it in the monophonic encoded data, and outputs the resultant data to the multiplexer 125.

In other words, the monophonic multimode encoding units 121 to 124 share the coding mode which was used for encoding the addition signal S.

The monophonic multimode encoding units 122 to 124 (corresponding to a second encoder) encode the difference signals X, Y, and Z inputted from the conversion unit 11, using the coding mode indicated in the mode information inputted from the monophonic multimode encoding unit 121, to generate the monophonic encoded data (corresponding to second encoded data). The monophonic multimode encoding units 122 to 124 output the monophonic encoded data to the multiplexer 125.

The multiplexer 125 multiplexes pieces of the encoded data inputted from the monophonic multimode encoding units 121 to 124 into the multichannel encoded data, and outputs it to a transmission line.

[Configuration of Decoding Device]

The decoding device 20 includes a decoding unit 21 and an inverse conversion unit 22 (corresponding to an inverse converter).

The decoding unit 21 separates the received multichannel encoded data into multiple pieces of monophonic encoded data and decodes the multiple pieces of monophonic encoded data to obtain decoded multichannel digital signals (S', X', Y', and Z').

Figure 4:
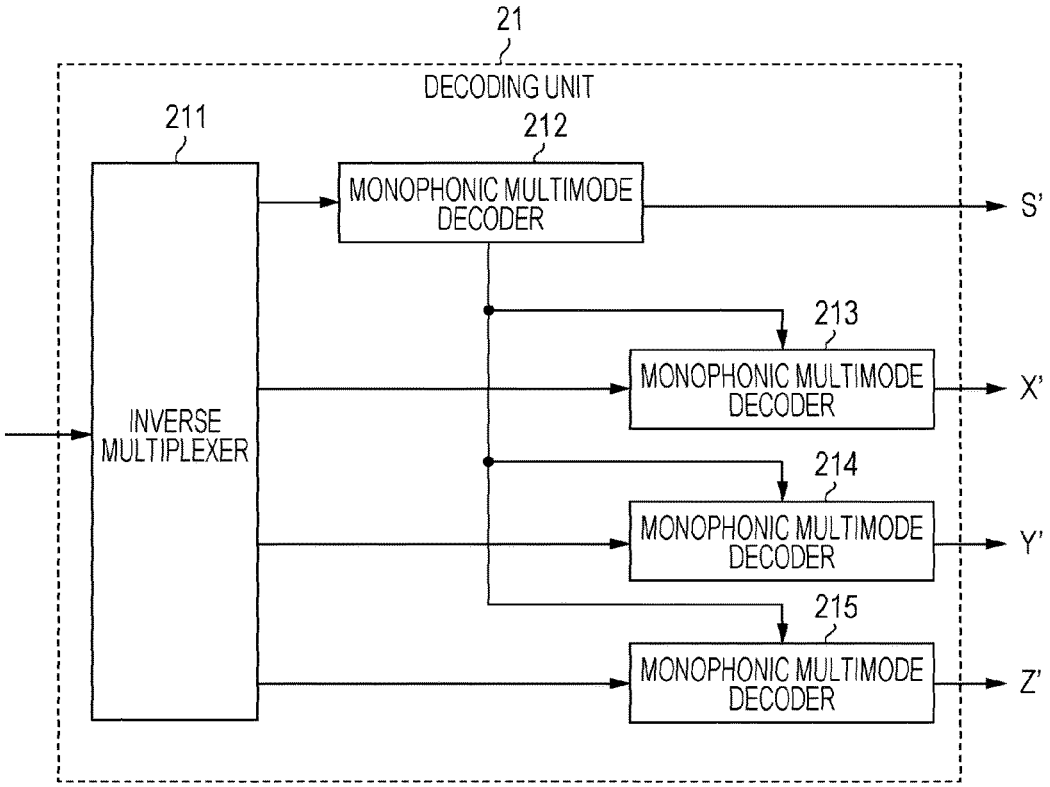
FIG. 4 is a diagram illustrating an example of the internal configuration of a decoding unit.

FIG. 4 illustrates an example of the internal configuration of the decoding unit 21. The decoding unit 21 illustrated in FIG. 4 includes an inverse multiplexer 211 and monophonic multimode decoding units 212 to 215.

The inverse multiplexer 211 separates the multichannel encoded data received from the encoding device 10 via the transmission line into monophonic encoded data corresponding to the addition signal and monophonic encoded data corresponding to the difference signals. The inverse multiplexer 211 outputs the monophonic encoded data corresponding to the addition signal to the monophonic multimode decoding unit 212 (corresponding to a first decoder), and outputs pieces of the monophonic encoded data corresponding to the respective difference signals, to the respective monophonic multimode decoding units 213 to 215 (corresponding to a second decoder). Note that the monophonic encoded data corresponding to the addition signal includes the mode information indicating the coding mode which was used for encoding the addition signal.

The monophonic multimode decoding unit 212 decodes the mode information inputted from the inverse multiplexer 211 to identify the coding mode which was used in the encoding device 10. The monophonic multimode decoding unit 212 decodes the monophonic encoded data corresponding to the addition signal S based on the identified coding mode and outputs the obtained decoded signal S' to the inverse conversion unit 22. In addition, the monophonic multimode decoding unit 212 outputs the mode information indicating the coding mode to the monophonic multimode decoding units 213 to 215.

In other words, the monophonic multimode decoding units 212 to 215 share the coding mode which was used for encoding the addition signal S in the encoding device 10.

The monophonic multimode decoding units 213 to 215 decode respective pieces of the monophonic encoded data corresponding to the difference signals X, Y, and Z, inputted from the inverse multiplexer 211, in accordance with the coding mode indicated in the mode information inputted from the monophonic multimode decoding unit 212, and outputs the resultant decoded signals X', Y', and Z' to the inverse conversion unit 22.

The inverse conversion unit 22 performs weighted addition on the decoded signals S', X', Y', and Z' inputted from the decoding unit 21, and converts the decoded signals S', X', Y', and Z' to decoded multichannel digital sound signals (ch1' to ch4').

Figure 5:
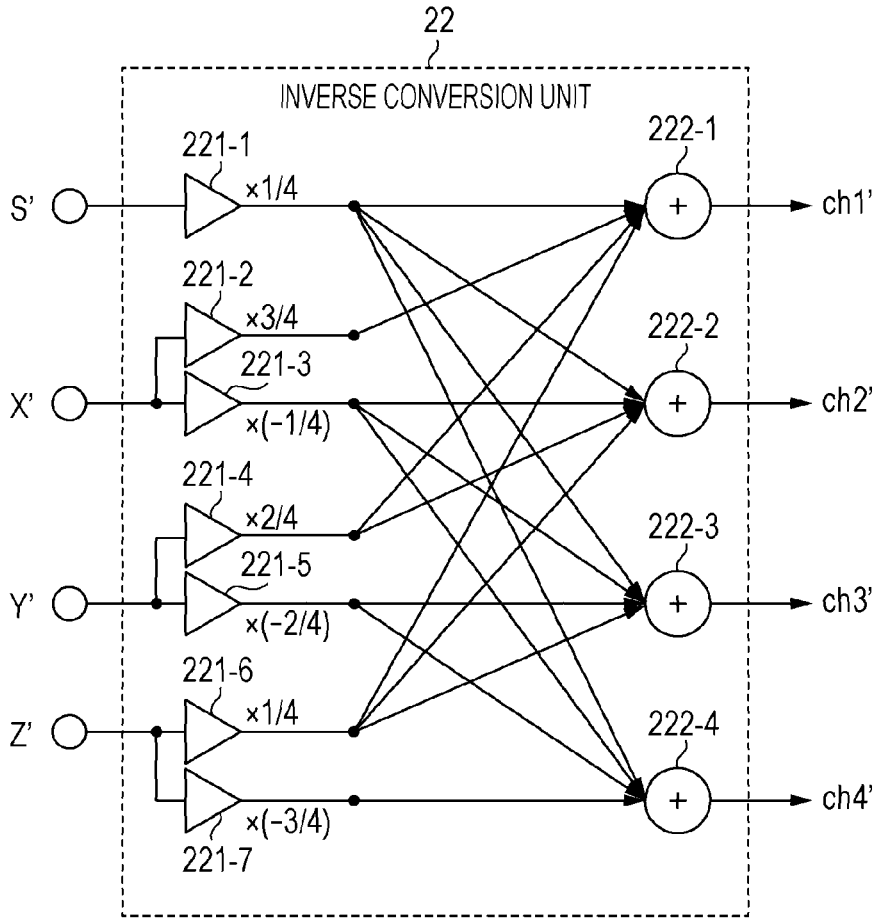
FIG. 5 is a diagram illustrating an example of the internal configuration of an inverse conversion unit.

FIG. 5 illustrates an example of the internal configuration of the inverse conversion unit 22. In FIG. 5, weighting coefficients for the decoded signals S', X', Y', and Z' are set in amplifiers 221-1 to 221-7. Adding units 222-1 to 222-4 add up signals outputted from the amplifiers 221-1 to 221-7 to generate decoded channel signals of multichannel digital sound signals.

For example, the amplifiers 221-1 to 221-7 and the adding units 222-1 to 222-4 use the following formulae to generate the decoded channel signals ch1' to ch4'.

$$ch1'=0.25\times(S'+3X'+2Y'+Z)$$

$$ch2'=0.25\times(S'-X'+2Y'+Z)$$

$$ch3'=0.25\times(S'-X'-2Y'+Z)$$

$$ch4'=0.25\times(S'-X'-2Y'-3Z) \quad \text{[Math. 1]}$$

[Effect]

As described above, in this embodiment, the encoding device 10 mixes multichannel signals into an addition signal of all channels and difference signals between channels, and then encodes the resultant signals. At this time, the encoding device 10 uses the coding mode determined in encoding the addition signal also for encoding the difference signals. The decoding device 20 decodes pieces of monophonic encoded data corresponding to the addition signal and the difference signals, in accordance with the coding mode which was used in the encoding device 10.

In this way, the addition signal is encoded and decoded, and the channel signals are reconstructed using the decoded addition signal. This makes it possible to commonize encoding errors added to the channel signals. In addition, commonizing the coding mode for the addition signal and the difference signals makes it possible to uniform the characteristics of the encoding errors added to the channel signals. This reduces the deterioration of the correlation between the channel signals. Thus, the decoding device 20 reduces the phase distortions between the decoded channel signals. In other words, the coding mode used in encoding/decoding is the same for all the channels, and all the channel signals are expressed by using the decoded signal of the average signal of all the channels. As a result, the decoding device 20 is capable of avoiding quality degradation of multichannel signals, in which the distortion characteristics of decoded signals are different between the channels, which is caused by using different coding modes at the same time or not sharing the encoding error among all the channels.

This makes it possible, for example, to reduce the influence of the encoding error on beamforming processing utilizing the phase relationship between the channel signals at a subsequent stage of the decoding device 20. In other words, this embodiment makes it possible to reduce the performance deterioration of beamforming in the case of performing beamforming processing using multichannel signals encoded by the EVS codec.

In addition, since the coding mode is shared among the monophonic multimode encoding units in the encoding device 10 and also among the monophonic multimode decoding units in the decoding device 20, the encoding device 10 does not need to encode the mode information for all the monophonic multimode encoding units 121 to 124. The encoding device 10 only needs to transmit a single piece of mode information to the decoding device 20.

In addition, since the encoding device 10 determines the coding mode based on the addition signal S of all the channels, the encoding device 10 can select an optimum coding mode for the entire multichannel. This is because the addition signal S includes average characteristics of the sound in multichannel sound signals while it is difficult to capture the characteristics of the sound from the difference signals X, Y, and Z the signal levels of which are smaller than the addition signal S.

In addition, this embodiment provides the effect of reducing the encoding distortion of the difference signals even in the case of calculating the difference signals after correcting the signal phases of adjacent channels.

Note that although in this embodiment, description is provided for an encoding device having multiple coding modes (multimode), the present disclosure can be applied to an encoding device that has only one coding mode and does not perform mode switching. For example, a conversion unit adds up all the multiple channel signals included in multichannel voice sound input signals of at least three channels to generate an addition signal of one channel, and generates at least two channels of difference signals between the channels of the multiple channel signals. In an encoding unit, a first encoder encodes the one-channel addition signal outputted from the conversion unit to generate first encoded data, and a second encoder encodes the difference signals of at least two channels to generate second encoded data. Then, a multiplexer multiplexes the first encoded data and the second encoded data to generate and output multichannel encoded data.

Also in this configuration, as in the multimode in this embodiment, encoding errors added to the channel signals can be commonized by reconstructing the channel signals using the decoded addition signal in the encoding unit, so that it is possible to reduce the influence of the encoding error on beamforming processing utilizing the phase relationship between the channel signals.

Also as for the decoding unit, although in this embodiment, description is provided for a decoding device that performs multiplexing in accordance with the coding mode indicated in the coding mode information outputted from the encoding device, the present disclosure can be applied to the case where the coding mode information is not inputted.

Embodiment 2

In this embodiment, description is provided for a capturing sound system that performs beamforming processing (capturing sound processing) on multichannel sound signals.

Figure 6:
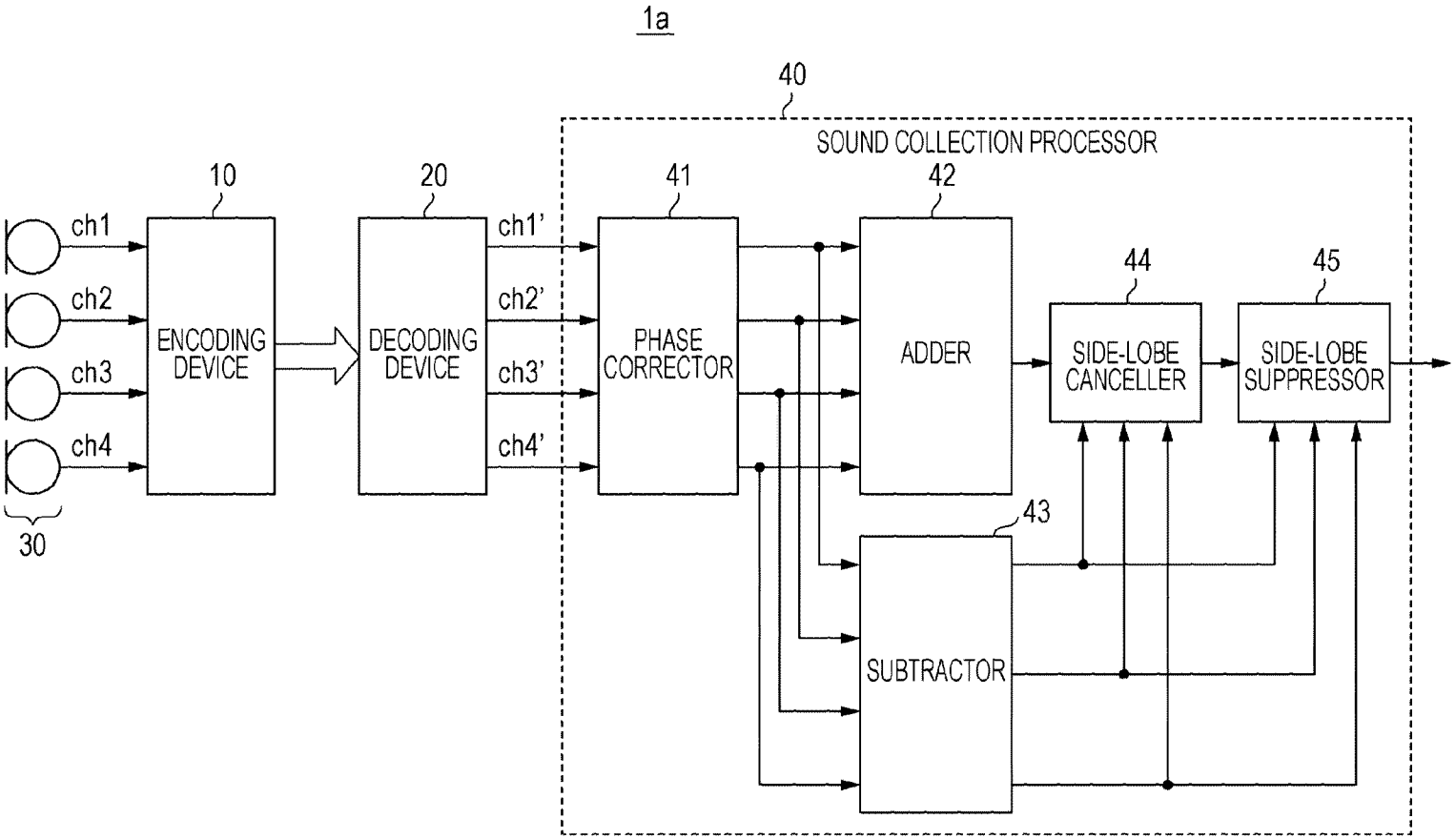
FIG. 6 is a diagram illustrating a configuration example of a capturing sound processing system.

FIG. 6 illustrates a configuration example of a capturing sound system according to this embodiment. A capturing sound system 1*a* illustrated in FIG. 6 includes a microphone array unit 30 and a capturing sound processor 40, and the encoding device 10 and decoding device 20 described in Embodiment 1.

The microphone array unit 30 includes multiple microphones (four microphones in FIG. 6) for converting sound signals into analog electrical signals and A/D conversion units for converting analog electrical signals to digital sound signals. The microphone array unit 30 outputs multichannel digital sound signals including digital sound signals (channel signals ch1 to ch4) corresponding to the microphones, to the encoding device 10.

As described in Embodiment 1, the encoding device 10 encodes the multichannel digital sound signals, and the decoding device 20 decodes multichannel encoded data received from the encoding device 10 and outputs decoded multichannel sound signals including decoded channel signals (ch1' to ch4'), to the capturing sound processor 40.

The capturing sound processor 40 performs beamforming processing on the decoded multichannel sound signals inputted from the decoding device 20 to extract and output only a signal to be collected (target signal).

Specifically, the capturing sound processor 40 includes a phase corrector 41, adder 42, subtractor 43, side-lobe canceller 44, and side-lobe suppressor 45.

The phase corrector 41 corrects the phases of the decoded channel signals of the decoded multichannel sound signals in accordance with the arrival direction of the target signal, and outputs the decoded channel signals after the phase correction to the adder 42 and the subtractor 43.

The adder 42 adds up all the decoded channel signals after the phase correction. In the addition signal, components of the target signal are emphasized. The adder 42 outputs the addition signal to the side-lobe canceller 44.

The subtractor 43 generates difference signals between adjacent channels from the decoded channel signals after the phase correction. In the difference signals between adjacent channels, the components of the target signal are cancelled, and noise components are emphasized. The subtractor 43 outputs the difference signals to the side-lobe canceller 44 and the side-lobe suppressor 45.

The side-lobe canceller 44 and the side-lobe suppressor 45 function as a suppressor which emphasizes the components of the target signal while suppressing components other than those of the target signal, using the addition signal inputted from the adder 42 and the difference signals inputted from the subtractor 43.

Specifically, the side-lobe canceller 44 eliminates the components corresponding the difference signals inputted from the subtractor 43 from the addition signal inputted from the adder 42 to suppress signal components other than those of the target signal (such as noise components) and emphasize the target signal.

The side-lobe suppressor 45 further suppresses the signal components other than those of the target signal in the frequency domain (spectral domain) to emphasize the target signal, using a signal inputted from the side-lobe canceller 44 and the difference signals inputted from the subtractor 43.

An output signal of the side-lobe suppressor 45 is outputted as a final output signal of the beamforming processing.

For example, in the capturing sound system 1*a*, the processing of the capturing sound processor 40 may be performed by a cloud server. In other words, the decoding device 20 may transmit the decoded multichannel sound signals to a cloud server connected thereto via a network such as the Internet, and the cloud server may perform the capturing sound processing.

In this way, this embodiment makes possible transmission of multichannel sound signals in which performance degradation in the capturing sound processing (beamforming processing) is suppressed.

The above is the description of the embodiments of the present disclosure.

Note that although with reference to FIG. 5, the description has been provided for the case of setting the weighting coefficients in the inverse conversion unit 22 of the decoding device 20, the weighting coefficients of the conversion unit 11 and the inverse conversion unit 22 can be changed as appropriate. For example, the weighting coefficients may be set in the conversion unit 11 of the encoding device 10. In this case, the conversion unit 11 uses Formulae 2 to generate the addition signal S and the difference signals X, Y, and Z.

$$S=0.25\times(ch1+ch2+ch3+ch4)$$

$$X=0.25\times(ch1-ch2)$$

$$Y=0.25\times(ch2-ch3)$$

$$Z=0.25\times(ch3-ch4) \quad \text{[Math. 2]}$$

In this case, the inverse conversion unit 22 uses Formulae 3 to generate the decoded channel signals ch1' to ch4'.

$$ch1'=S'+3X'+2Y'+Z$$

$$ch2'=S'-X'+2Y'+Z$$

$$ch3'=S'-X'-2Y'+Z$$

$$ch4'=S'-X'-2Y'-3Z \quad \text{[Math. 3]}$$

Meanwhile, for example, in the capturing sound system 1*a*, if the content of the addition processing of the adder 42 and the subtraction processing of the subtractor 43 in the capturing sound processing is different from that of this embodiment, the content of the weighted addition in the conversion unit 11 and the inverse conversion unit 22 may be changed to fit it.

In addition, an aspect of the present disclosure is not limited to the above embodiments but can be variously modified.

For example, X, Y, and Z may be difference signals between channels as expressed by Formulae 4.

$$X=(ch1+ch2)-(ch3+ch4)$$

$$Y=(ch1+ch3)-(ch2+ch4)$$

$$Z=(ch1+ch4)-(ch2+ch3) \quad \text{[Math. 4]}$$

It is also possible to derive decoded channel signals ch1' to ch4' fitting them.

In addition, although in the above embodiments, description has been provided for an example in which an aspect of the present disclosure is implemented by hardware, it is also possible to implement the present disclosure using software in cooperation with hardware.

The function blocks used in the explanation of the above embodiments are typically implemented as an LSI, which is an integrated circuit. The integrated circuit may control the function blocks used in the explanation of the embodiments and have input terminals and output terminals. These may be separately formed into chips, or one chip may be formed including part or all of them. Although here an LSI is referred to, it may be called an IC, system LSI, super LSI, or ultra LSI depending on the degree of integration.

The method of integrating circuits is not limited to an LSI, it may be achieved by a dedicated circuit or a general-purpose processor. It also possible to use a field-programmable gate array (FPGA) which is programmable after the LSI is manufactured or a reconfigurable processor in which connections or settings of circuit cells inside the LSI can be reconfigured.

Further, if an integrated circuit technology replacing LSI appears from the advance of semiconductor technology or another technology derived from it, it is natural that the technology may be used to integrate the function blocks. It may be possible to apply technology such as biotechnology.

An audio sound signal encoding device according to the present disclosure includes: a converter that adds up all multiple channel signals included in multichannel voice sound input signals to generate an addition signal and generates a difference signal between channels of the multiple channel signals; a first encoder that encodes the addition signal in a coding mode in accordance with a characteristic of the addition signal to generate first encoded data; a second encoder that encodes the difference signal in the coding mode that was used for encoding the addition signal, to generate second encoded data; and a multiplexer that multiplexes the first encoded data and the second encoded data to generate multichannel encoded data.

An audio sound signal encoding device according to the present disclosure includes: a converter that adds up all multiple channel signals included in multichannel voice sound input signals of at least three channels to generate an addition signal of one channel and generates difference signals of at least two channels between channels of the multiple channel signals; a first encoder that encodes the addition signal of one channel to generate first encoded data; a second encoder that encodes the difference signals of at least two channels to generate second encoded data; and a multiplexer that multiplexes the first encoded data and the second encoded data to generate multichannel encoded data.

In an audio sound signal encoding device according to the present disclosure, the voice sound input signals are signals outputted from a microphone array unit.

In an audio sound signal encoding device according to the present disclosure, the difference signal is a difference signal between adjacent channels of the multiple channel signals.

In an audio sound signal encoding device according to the present disclosure, the first encoded data includes mode information indicating the coding mode that was used for encoding the addition signal.

An audio sound signal decoding device according to the present disclosure, first, separates multichannel encoded data outputted from an audio sound signal encoding device into first encoded data and second encoded data. The audio sound signal decoding device according to the present disclosure includes: an inverse multiplexer, a first decoder, a second decoder, and an inverse converter. In the inverse multiplexer, the first encoded data is generated in the audio sound signal encoding device by encoding an addition signal in a coding mode in accordance with a characteristic of the addition signal, the addition signal being generated by adding up all multiple channel signals included in multichannel voice sound input signals. In the inverse multiplexer, the second encoded data is generated in the audio sound signal encoding device by encoding a difference signal in the coding mode that was used for encoding the addition signal, the difference signal being difference between channels of the multiple channel signals. The first decoder decodes the first encoded data in the coding mode that was used for encoding the addition signal, to obtain a decoded addition signal. The second decoder decodes the second encoded data in the coding mode that was used for encoding the addition signal, to obtain a decoded difference signal. Further, the inverse converter performs weighted addition on the decoded addition signal and the decoded difference signal to generate decoded audio sound signals.

In an audio sound signal decoding device according to the present disclosure, the difference signal is a difference signal between adjacent channels of the multiple channel signals.

In an audio sound signal decoding device according to the present disclosure, the first encoded data includes mode information indicating the coding mode that was used for encoding the addition signal.

A capturing sound system according to the present disclosure includes a capturing sound processor that performs beamforming processing on the decoded audio sound signals outputted from the decoding device according to claim 5 to extract a target signal. The capturing sound processor includes: a phase corrector that corrects phases of decoded channel signals included in the decoded audio sound signals; an adder that adds up all the decoded channel signals after the phase correction to generate an addition signal; a subtractor that generates a difference signal between adjacent channels of the decoded channel signals after the phase correction; and a suppressor that emphasizes a component of the target signal and suppresses a component other than the component of the target signal, using the addition signal and the difference signal.

In an audio sound signal encoding method according to the present disclosure, all multiple channel signals included in multichannel voice sound input signals are added up to generate an addition signal and generating a difference signal between channels of the multiple channel signals. The addition signal is encoded in a coding mode in accordance with a characteristic of the addition signal to generate first encoded data; the difference signal is encoded in the coding mode that was used for encoding the addition signal, to generate second encoded data; and the first encoded data and the second encoded data are multiplexed to generate multichannel encoded data.

In an audio sound signal decoding method according to the present disclosure, multichannel encoded data outputted from an audio sound signal encoding device is separated into first encoded data and second encoded data. The first encoded data is generated in the audio sound signal encoding device by encoding an addition signal in a coding mode in accordance with a characteristic of the addition signal, the addition signal being generated by adding up all multiple channel signals included in multichannel voice sound input signals. The second encoded data is generated in the audio sound signal encoding device by encoding a difference signal in the coding mode used for encoding the addition signal, the difference signal being difference between channels of the multiple channel signals. The first encoded data is decoded in the coding mode that was used for encoding the addition signal, to obtain a decoded addition signal. The second encoded data is decoded in the coding mode that was used for encoding the addition signal, to obtain provide a decoded difference signal. Weighted addition is performed on the decoded addition signal and the decoded difference signal to generate decoded audio sound signals.

An aspect of the present disclosure is useful for a device that performs encoding and decoding on multichannel voice sound signals.

What is claimed is:

1. An audio sound signal encoding device, comprising:

a converter that adds up all multiple channel signals included in multichannel voice sound input signals to generate an addition signal and generates a difference signal between channels of the multiple channel signals;

a first encoder that encodes the addition signal to generate first encoded data; and a second encoder that encodes the difference signal to generate second encoded data;

characterized by the first encoder determining a coding mode in accordance with a characteristic of the addition signal and encoding the addition signal in the determining coding mode:

the second encoder encoding the difference signal in the coding mode that was used for encoding the additional signal; and a multiplexer that multiplexes the first encoded data and the second encoded data to generate multichannel encoded data.

2. The audio sound signal encoding device according to claim 1, wherein the voice sound input signals are signals outputted from a microphone array.

3. The audio sound signal encoding device according to claim 1, wherein the difference signal is a difference signal between adjacent channels of the multiple channel signals.

4. The audio sound signal encoding device according to claim 1, wherein the first encoded data includes mode information indicating the coding mode that was used for encoding the addition signal.

5. The audio sound signal encoding device according to claim 1, wherein the difference signal is a difference signal between adjacent channels of the four channel signals (ch1, ch2, ch3, ch4), and is calculated on the basis of the following $$X=(ch1+ch2)-(ch3+ch4)$$

$$Y=(ch1+ch3)-(ch2+ch4)$$

$$Z=(ch1+ch4)-(ch2+ch3).$$

6. An audio sound signal decoding device, comprising:

an inverse multiplexer that separates multichannel encoded data outputted from an audio sound signal encoding device into first encoded data and second encoded data, the first encoded data being generated in the audio sound signal encoding device by encoding an addition signal, the addition signal being generated by adding up all multiple channel signals included in multichannel voice sound input signals, and the second encoded data being generated in the audio sound signal encoding device by encoding a difference signal, the difference signal being a difference between channels of the multiple channel signals;

a first decoder that decodes the first encoded data in the coding mode that was used for encoding the addition signal, to obtain a decoded addition signal;

a second decoder that decodes the second encoded data to obtain a decoded difference signal; and an inverse converter that performs weighted addition on the decoded addition signal and the decoded difference signal to generate decoded audio sound signals;

characterized by the first encoded data being generated by encoding the addition signal in a coding mode determined in accordance with a characteristic of the addition signal, the second encoded data being generated by encoding the difference signal in the coding mode that was used for encoding the addition signal, and the second decoder decoding the second encoded date in the coding mode that was used for encoding the addition signal.

7. The audio sound signal decoding device according to claim 6, wherein the difference signal is a difference signal between adjacent channels of the multiple channel signals.

8. The audio sound signal decoding device according to claim 6, wherein the first encoded data includes mode information indicating the coding mode that was used for encoding the addition signal.

9. A capturing sound system, comprising:

a capturing sound processor that performs beamforming processing on decoded audio sound signals outputted from the decoding device according to claim 6 to extract a target signal, the capturing sound processor including a phase corrector that corrects phases of decoded channel signals included in the decoded audio sound signals;

an adder that adds up all the decoded channel signals after the phase correction to generate an addition signal;

a subtractor that generates a difference signal between adjacent channels of the decoded channel signals after the phase correction; and a suppressor that emphasizes a component of the target signal and suppresses a component other than the component of the target signal, using the addition signal and the difference signal.

10. An audio sound signal encoding method, comprising:

adding up all multiple channel signals included in multichannel voice sound input signals to generate an addition signal and generating a difference signal between channels of the multiple channel signals;

encoding the addition signal to generate first encoded data; and encoding the difference signal, to generate second encoded data;

characterized by determining a coding mode in accordance with a characteristic of the addition signal;

the additional signal being encoded in the determined coding mode;

the difference signal being encoded in the coding mode that was used for encoding the addition signal; and multiplexing the first encoded data and the second encoded data to generate multichannel encoded data.

11. An audio sound signal decoding method, comprising:

separating multichannel encoded data outputted from an audio sound signal encoding device into first encoded data and second encoded data, the first encoded data being generated in the audio sound signal encoding device by encoding an addition signal, the addition signal being generated by adding up all multiple channel signals included in multichannel voice sound input signals, and the second encoded data being generated in the audio sound signal encoding device by encoding a difference signal, the difference signal being a difference between channels of the multiple channel signals;

decoding the first encoded data in the coding mode that was used for encoding the addition signal, to obtain a decoded addition signal;

decoding the second encoded data to obtain a decoded difference signal; and performing weighted addition on the decoded addition signal and the decoded difference signal to generate decoded audio sound signals;

characterized by the first encoded data being generated by encoding the addition signal in a coding mode determined in accordance with a characteristic of the addition signal, the second encoded data being generated by encoding the difference signal in the coding mode that was used for encoding the addition signal; and decoding the second encoded data in the coding mode that was used for encoding the addition signal.

* * * * *